US006288349B1

(12) United States Patent
Motyka et al.

(10) Patent No.: US 6,288,349 B1
(45) Date of Patent: Sep. 11, 2001

(54) PANEL MOUNTED CONTROLLER AND INTEGRATED SELECTOR SWITCH

(75) Inventors: Larry J. Motyka, Batavia; Phillip Hawken, Darien; Jeffrey A. Puskas, Prospect Heights; Robert J. Alvord, Emerywood Park; Jeffery J. Makeever, Rockford, all of IL (US)

(73) Assignee: Ranco Incorporated of Delaware, Wilmington, DE (US)

( * ) Notice: Subject to any disclaimer, the term of this patent is extended or adjusted under 35 U.S.C. 154(b) by 0 days.

(21) Appl. No.: 09/376,224

(22) Filed: Aug. 18, 1999

Related U.S. Application Data

(60) Provisional application No. 60/097,095, filed on Aug. 19, 1998.

(51) Int. Cl.[7] ..... H01H 9/00; G12B 9/00

(52) U.S. Cl. ..... 200/296; 248/27.1; 361/807

(58) Field of Search ..... 200/292, 293–296, 200/11 R–11 TW; 248/27.1; 361/728, 803–812

(56) References Cited

U.S. PATENT DOCUMENTS

| | | | | |
|---|---|---|---|---|
| 2,272,688 | * | 2/1942 | Catron | 200/296 X |
| 2,689,700 | * | 9/1954 | Drury | 248/27.1 |
| 3,279,728 | * | 10/1966 | Campbell | 248/27.1 |
| 4,653,708 | * | 3/1987 | Rich | 248/27.1 |
| 4,682,267 | * | 7/1987 | Magilton | 361/837 |
| 4,861,951 | * | 8/1989 | Olson | 200/11 DA |
| 4,892,987 | * | 1/1990 | Aframian | 200/296 |
| 5,010,445 | * | 4/1991 | Weinold | 361/728 |
| 5,225,970 | * | 7/1993 | Palumbo | 361/807 |
| 6,147,863 | * | 11/2000 | Moore et al. | 361/803 |

* cited by examiner

*Primary Examiner*—J. R. Scott
(74) *Attorney, Agent, or Firm*—John M. England, Jr.; Terrence (Terry) Martin; Jules Jay Morris

(57) ABSTRACT

A method and apparatus for mounting a controller (30) along with its program selector switch (36) and other electrical components (34) on appliance front panels is disclosed. A twist mount (40) removably mounts a selector switch (36) and printed circuit board (32) to a control panel (20) of an appliance. The switch (36) may be positioned off-center on the printed circuit board (32) in a manner creating a gravity-based rotational torque force on the twist mount (40), such that the printed circuit board (32) acts as a cantilever arm during mounting, and the selector switch (36) is held in the mounted position via the gravity force after mounting.

31 Claims, 2 Drawing Sheets

PANEL MOUNTED CONTROLLER AND INTEGRATED SELECTOR SWITCH

RELATED APPLICATION

This application claims priority to U.S. Provisional Application 60/097,095 , filed Aug. 19, 1998, for all subject matter common to both applications. The disclosure of said same provisional application is hereby incorporated by reference in its entirety.

TECHNICAL FIELD

The present invention relates to program selectors for appliances, and more particularly to panel mounted selector switches and their associated control modules for use with electronically controlled appliances.

BACKGROUND ART

Consumer and commercial appliances have long used program selector switches mounted on a front panel of an appliance that is accessible by the customer. Typically, these selector controls have taken the form of rotary switches, which utilize a cam and follower mechanism or other similar electromechanical device, for varying the operation of the appliance. The manufacturing costs of such electromechanical timers have been reduced regularly in recent decades, while new controls and functions have been added. In a typical application, a user rotates the selector switch to a given program indicated on the front panel of the appliance, thereafter beginning operation of the selected program. In the past, a simple timer mechanism rotated the cam and follower assembly to electromechanically control the operation of the appliance.

Various attempts to substitute electronic controls have failed due to inadequate reliability and operating environment limitations, and especially, to unfavorable cost comparisons with the mechanical cam/switch controls. The advent of reliable and inexpensive control electronic devices, along with other improvements disclosed herein have made possible the implementation of these more advanced electronics to control the program operation of many appliances. Such electronics can effectively replace the older electromechanical cam type devices for program timing, switching, and selection.

FIG. 2 illustrates in simplified form, an electronic control panel installed in an appliance. As may be seen, a prior art electronic control board 10 having a connector 12 included therewith interfaces with a program selector switch 14 through a wiring harness 16 having at the end thereof a connector 18. The program selector switch 14 is typically mounted on an appliance front panel 20 via various mechanisms. Recently, selector switches 14 have begun to implement a simple twist lock mounting mechanism which allows the selector arm portion to be inserted through a mounting hole, such as mounting hole 22, on the appliance front panel 20. The selector switch 14 implementing such a twist lock mechanism is then rotated through a given angle to lock the switch in place on the front panel 20. A selector switch knob (not illustrated) is then inserted on the control arm of the switch.

In addition to the mounting of the selector switch 14, the prior art control board 10 is also mounted within the appliance. Typically, the prior art control board 10 was mounted via mounting screws and insulated spacers 24 on the frame of the appliance. The particular location of the control board 10 often proved difficult due to the limitation on the available space within the appliance. Service requirements also dictated that the front panel 20 be removable from the appliance, such as for maintenance operations or the like. This necessitated a lengthy wiring harness 16 to interface between the front panel mounted switch 14 and the frame mounted control board 10. Because most appliance structures are of sheet metal construction, there exist many sharp edges from stamping operations within the interior of the appliance behind the front panel 20. These sharp edges caused chaffing of the insulation of the wiring harness 16 and the potential for extremely hazardous short-circuiting of the power and/or control wires contained therein.

To overcome this problem, some prior designs utilized wiring harnesses 16 that were as short as possible. Unfortunately, this approach greatly increased the difficulty of maintaining a connection between connectors 12 and 18 during and after servicing of the appliance when the front panel 20 was removed. In addition to the problems associated with decreased reliability and increased difficulty of servicing, the prior systems also bore an increased cost over their predecessors. This increased cost was driven in part by the increased number of components required to make the connection between the panel mounted selector switch 14 and the control board 10. Additionally, the necessary mounting bracket included within the appliance to allow the control board 10 to be mounted thereto also increased the overall cost of this electronic control. The increased costs and reduced reliability has greatly impacted the widespread implementation of this technology over its predecessor electromechanical technology. Because of this impact, electromechanical selector switches are still widely found in many appliances.

DISCLOSURE OF INVENTION

In view of the foregoing limitations and shortcomings of the above noted devices, as well as other disadvantages not specifically mentioned, there exists in the art a need for an improved panel mounted controller and integrated selector switch for use with electronic appliances, and the like.

The present invention is directed to a selector switch mounting assembly. A twist mount removably mounts a selector switch to a control panel of an appliance. The selector switch is also mounted on a printed circuit board. The switch may be positioned on the printed circuit board in a manner such that the printed circuit board extends relatively more to one side than the other from the switch. The extension of the circuit board creates a gravity-based rotational torque force on the twist mount, such that the twist mount is held in the mounted position.

Other features of the disclosed embodiment may include some or all of the following. The twist mount selector switch includes a locking mechanism to lock the switch and printed circuit board in place behind the control panel. Further, a control arm extends from the selector switch, through the control panel, and ends with a removably mounted selector knob allowing the user to operate the appliance.

BRIEF DESCRIPTION OF THE DRAWINGS

The aforementioned features, as well as other features and aspects of the present invention, will become better understood with regard to the following description and accompanying drawings, wherein.

Figure 1:
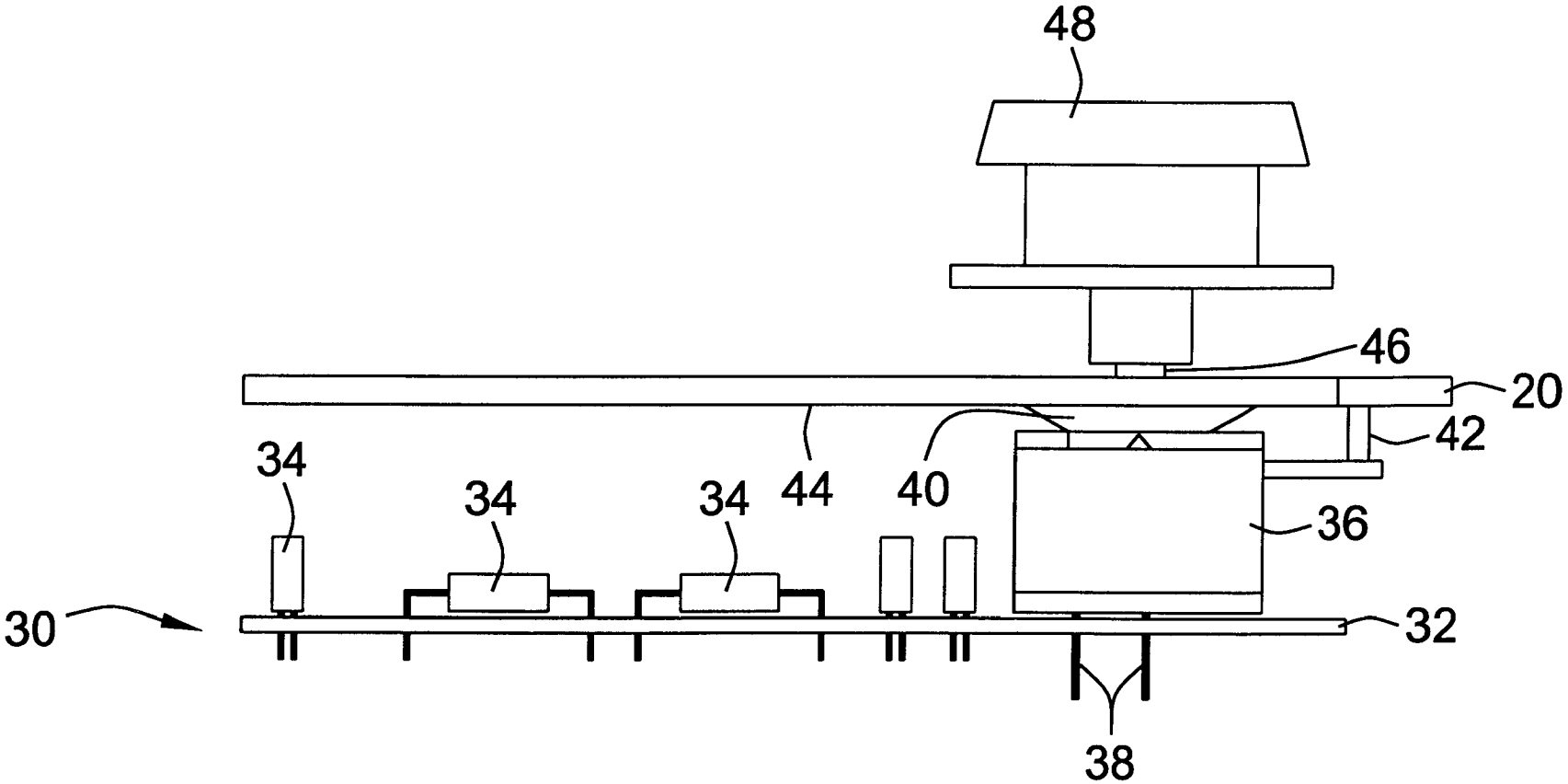
FIG. 1 is a top view schematic of one embodiment of the integrated appliance controller of the present invention.

While the invention is susceptible of various modifications and alternative constructions, certain illustrative embodiments thereof have been shown in the drawings and will be described below in detail. It should be understood, however, applicants intend not to limit the invention to the specific forms disclosed. On the contrary, applicants intend to cover all modifications, alternative constructions, and equivalents falling within the spirit and scope of the invention as defined by the appended claims.

BEST MODE FOR CARRYING OUT THE INVENTION

Figure 2:
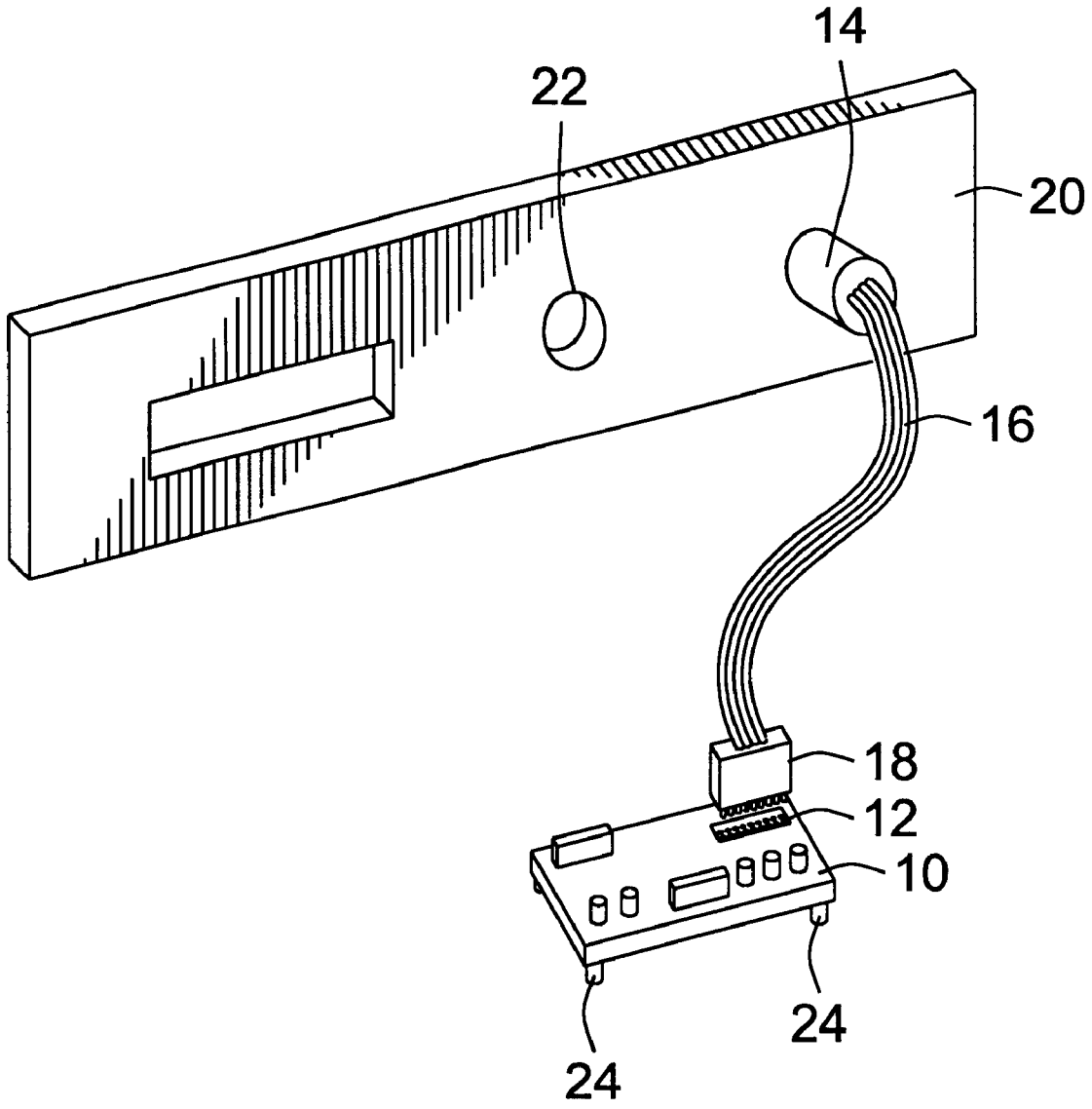
FIG. 2 (PRIOR ART)
FIG. 2 is a schematic of a typical prior art front panel mounted selector switch and an electronic controller installation for an appliance.

Referring now in detail to the drawing figures wherein like parts are designated by like reference numerals throughout, there is illustrated in FIGS. 1 and 2, the following.

One illustrative embodiment of the present invention is shown in block diagram form in FIG. 1. The electronic controller 30 of the present invention comprises a printed circuit board (PCB) 32 having mounted thereon various electronic components 34 in a conventional manner. In addition to the electronic components 34, the controller 30 of the present invention also includes a twist-mount selector switch 36 which is also mounted directly to the printed circuit board 32 by soldered connections on control pins 38.

Preferably, the printed circuit board mounted selector switch 36 utilizes a twist mount 40 for mounting through a mounting aperture (not shown) on the front panel 20 of a consumer or commercial appliance. This printed circuit board mounted selector switch 36 may also include a separate locking mechanism 42 which may engage a locking indentation (not shown) on the backside 44 of the front panel 20. Once locked in place, a control arm 46 of the printed circuit board mounted selector switch 36 extends through the front panel 20. A selector switch knob 48 may then be inserted over this control arm 46 to provide a user interface to the electronic controller 30.

FIG. 1 reveals that in the present illustrated embodiment, the entire support for the printed circuit board 32 is provided by the front control panel 20 interface provided by the printed circuit board mounted selector switch 36. This approach to mounting eliminates the necessity for a provision within the frame of the appliance for mounting the control board. This implementation also eliminates the troublesome wiring harness required to provide electrical connection between the selector switch and the control board of prior systems. The expensive multiple pin connectors have also been eliminated by the system of the present invention.

The overall reduction in parts alone has resulted in significant cost savings in a highly cost competitive market for consumer and commercial appliances. The manufacturability and serviceability of electronic appliances utilizing the present invention are greatly increased. Unreliability and shock hazards resulting from pinching the wiring harness 16 (see FIG. 2) coupling the front panel mounted switch 14 to the appliance frame mounted control board 10 is also eliminated, greatly increasing the safety and reliability of the present invention. Additionally, loosening of the multiple pin connector 12, 18 is also no longer a concern, nor is the potential for pin-to-pin failure from introduction of foreign material such as often occurs in a poorly seated connector.

The physical placement of the printed circuit board mounted selector switch 36 on the printed circuit board 32 and the orientation of the printed circuit board 32 relative to the front panel 20 aids in the physical locking of the twist mount mechanism formed by twist mount 40 and locking mechanism 42. For example, the offset weight from the length of the printed circuit board 32 (or equivalent offset weight) which extends beyond the outer diameter of the switch 36 provides a significant moment arm which increases the rotational moment of the switch 36. This relatively simple structure makes it more difficult (requiring more force) to loosen and unlock the twist mount 40 and locking mechanism 42 by simple rotation. For selector switches that utilize a counterclockwise locking mechanism, the switch is preferably mounted off center and on one end of the printed circuit board 32 such that the printed circuit board 32 provides a cantilevered torque arm. Through the force of gravity, this torque arm provides a counterclockwise supplementary torque force on the selector switch 36 to aid in retaining the switch 36 in the locked position. Likewise, if the switch 36 utilizes a clockwise locking mechanism, the switch 36 can be mounted off center (or an equivalent mass provided off center), and preferably on the other end of the printed circuit board 32. The majority of the printed circuit board 32 would then extend beyond the switch to form a cantilevered torque arm which, through the force of gravity, provides a clockwise force aiding in the maintenance of the locked position on the customer front panel 20.

In the top view of FIG. 1, the printed circuit board mounted selector switch 36 utilizes a counterclockwise locking mechanism for the twist mount lock. As gravity acts on the portion of the printed circuit board 32 which extends to the left of the printed circuit board mounted selector switch 36, a cantilevered force is applied through the switch 36 to maintain a locking force on the twist mount 40 and locking mechanism 42. In this way, the twist-mount selector switch 36 is unlikely to vibrate loose or become unlocked through rotating action of the selector switch knob 48. This structure thus provides an unforeseen advantage, actually increasing the reliability of the locking mechanism itself.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure may be varied substantially without departing from the spirit of the invention, and exclusive use of all modifications that come within the scope of the appended claims is reserved.

What is claimed is:

1. A selector switch mounting assembly, comprising:

a selector switch;

a twist mount removably mounting a first side of said selector switch to a control panel of an appliance; and, a printed circuit board having mounted thereon a plurality of electronic components including said selector switch.

2. The selector switch mounting assembly of claim 1, wherein said selector switch is a rotary switch.

3. The selector switch mounting assembly of claim 1, wherein said plurality of electronic components mounted on said printed circuit board include electrical switch contact components for functionally controlling electrical current to said appliance.

4. The selector switch mounting assembly of claim 1, further comprising a locking mechanism on said twist mounted selector switch.

5. The selector switch mounting assembly of claim 1, further comprising a control arm extending from said selector switch through said control panel.

6. The selector switch mounting assembly of claim 5, further comprising a selector switch knob removably mounted on said control arm.

7. The selector switch mounting assembly of claim 5, wherein said twist mount locks said selector switch into place.

8. The selector switch mounting assembly of claim 7, wherein said twist mount locks said selector switch into place with a counterclockwise rotation relative to an axis parallel to said control arm as viewed from a front side of said control panel.

9. The selector switch mounting assembly of claim 8, wherein said selector switch is mounted off-center toward an end of said printed circuit board such that when said selector switch is mounted vertically to said control panel, said printed circuit board extends primarily in a first direction from said selector switch to form a cantilevered torque arm creating a counterclockwise gravity torque load on said twist mount as viewed from said front side of said control panel.

10. The selector switch mounting assembly of claim 7, wherein said twist mount locks said selector switch into place via a clockwise rotation relative to an axis parallel to said control arm as viewed from a front side of said control panel.

11. The selector switch mounting assembly of claim 10, wherein said selector switch is mounted off-center toward an end of said printed circuit board such that when said selector switch is mounted vertically to said control panel, said printed circuit board extends primarily in a second direction from said selector switch to form a cantilevered torque arm creating a clockwise gravity torque load on said twist mount as viewed from said front side of said control panel.

12. The selector switch mounting assembly of claim 8, wherein said selector switch is mounted off-center toward an end of said printed circuit board such that said printed circuit board extends primarily in a first direction from said selector switch to form a cantilevered torque arm to aid in mounting said assembly on said control panel.

13. The selector switch mounting assembly of claim 10, wherein said selector switch is mounted off-center toward an end of said printed circuit board such that said printed circuit board extends primarily in a second direction from said selector switch to form a cantilevered torque arm to aid in mounting said assembly on said control panel.

14. A selector switch mounting assembly, comprising:

a selector switch;

a twist mount removably mounting a first side of said selector switch to a control panel of an appliance; and a printed circuit board having mounted thereon a plurality of electronic components including said selector switch, wherein said plurality of electronic components mounted on said printed circuit board include electrical switch contact components for functionally controlling electrical current to said appliance.

15. The selector switch mounting assembly of claim 14, further comprising a locking mechanism on said twist mounted selector switch.

16. The selector switch mounting assembly of claim 14, wherein said twist mount locks said selector switch into place.

17. The selector switch mounting assembly of claim 14, wherein said selector switch is mounted off-center toward an end of said printed circuit board such that when said selector switch is twisted in a first rotational direction and mounted to said control panel, said printed circuit board extends to form a cantilevered torque arm creating a rotational gravity torque load in said first rotational direction on said twist mount as viewed from said front side of said control panel.

18. The selector switch mounting assembly of claim 14, wherein said selector switch is mounted off-center toward an end of said printed circuit board such that said printed circuit board extends primarily in a first direction from said selector switch to form a cantilevered torque arm to aid in mounting said assembly on said control panel.

19. An electronic controller adapted to be mounted on an appliance comprising:

a circuit board;

a selector switch mounted on said circuit board, said selector switch adapted to be attached to the appliance; and said selector switch is mounted on said circuit board at a location whereby said circuit board forms a cantilevered torque arm, providing an aiding force to maintain said selector switch in position on the appliance.

20. The electronic controller of claim 19 wherein said selector switch is adapted to be mounted to the appliance with a twist mount mechanism, said selector switch mounted at a location on said circuit board where a sufficient area of said circuit board extends beyond said selector switch to form said cantilevered torque arm, said cantilevered torque arm providing a force to maintain said selector switch in position on the appliance.

21. The electronic controller of claim 20 wherein said location on said circuit board is offset from a center of said circuit board so that a first side of said circuit board is longer than a second side of said circuit board.

22. The electronic controller of claim 20 wherein said twist mount mechanism is a clockwise twist mount mechanism and said selector switch is mounted at a location to provide a cantilevered torque arm that provides a clockwise force to maintain said selector switch in position on said appliance.

23. The electronic controller of claim 20 wherein said twist mount mechanism is a counterclockwise twist mount mechanism and said selector switch is mounted at a location to provide a cantilevered torque arm that provides a counterclockwise force to maintain said selector switch in position on said appliance.

24. The electronic controller of claim 20 wherein said selector switch includes a locking mechanism, said locking mechanism securing said circuit board in relation to the appliance in a secured position.

25. The electronic controller of claim 19 wherein said selector switch is soldered to said circuit board.

26. Electronic controller for use with an appliance comprising:

a circuit board;

a selector switch mounted on said circuit board, said selector switch mounted to an appliance with a twist mount mechanism; and said selector switch is mounted on said circuit at a location whereby said circuit board forms a cantilevered torque arm, providing an aiding force said selector switch in position on said appliances.

27. The electronic controller of claim 26 wherein said twist mount mechanism is a counterclockwise twist mount mechanism, said selector switch mounted at a location on said circuit board where a sufficient area of said circuit board extends beyond said selector switch to form said cantilevered torque arm, said cantilevered torque arm providing a counterclockwise force to maintain said selector switch in position on the appliance.

28. The electronic controller of claim 26 wherein said twist mount mechanism is a clockwise twist mount mechanism, said selector switch mounted at a location on said circuit board where a sufficient area of said circuit board extends beyond said selector switch to form said cantilevered torque arm, said cantilevered torque arm providing a clockwise force to maintain said selector switch in position on the appliance.

29. The electronic controller of claim 27 wherein said selector switch includes a locking mechanism, said locking mechanism securing said circuit board in relation to the appliance in a secured position.

30. The electronic controller of claim 28 wherein said selector switch includes a locking mechanism, said locking mechanism securing said circuit board in relation to the appliance in a secured position.

31. The electronic controller of claim 29 wherein said locking mechanism engages an indentation on the appliance to secure said circuit board to the appliance.

* * * * *